United States Patent [19]

Stackhouse

[11] 4,232,501

[45] Nov. 11, 1980

[54] ECONOMY AUTOMATIC WRAPPING APPARATUS

[75] Inventor: William H. Stackhouse, Pamyra, Ind.

[73] Assignee: Lantech Inc., Louisville, Ky.

[21] Appl. No.: 901,634

[22] Filed: May 1, 1978

[51] Int. Cl.[3] ..... B65B 11/04

[52] U.S. Cl. ..... 53/399; 53/441; 53/465; 53/556; 53/587

[58] Field of Search ..... 53/399, 441, 465, 556, 53/587, 588, 589, 211; 100/15, 27

[56] References Cited

U.S. PATENT DOCUMENTS

| | | | |
|---|---|---|---|
| 2,837,884 | 6/1958 | Gibbons | 53/585 |
| 3,003,297 | 10/1961 | Broadhead et al. | 100/271 |
| 3,221,641 | 12/1965 | Adams et al. | 100/15 |
| 3,262,246 | 7/1966 | Olsen | 53/587 |
| 3,331,312 | 7/1967 | Leslie et al. | 53/589 X |
| 4,077,179 | 3/1978 | Lancaster et al. | 53/441 |

FOREIGN PATENT DOCUMENTS

| | | | |
|---|---|---|---|
| 1360865 | 4/1964 | France | 53/211 |

*Primary Examiner*—John Sipos
*Attorney, Agent, or Firm*—Gipple & Hale

[57] ABSTRACT

An apparatus and process for automatically wrapping packages with a full-web or spiral overwrap. The apparatus includes a film handling assembly in which stretched film is wrapped around the load rotated by a turntable. When the load is stopped in a home position a cutting and sealing assembly is transported into the film path, engaging the film and displacing it out of its original dispensed path. Rotatable clamps mounted on the turntable are rotated upward to grab the lower portion of the stretched film web while the sealing mechanism of the assembly engages the trailing edge of the film web to hold it against the film wrap, after which a cutter blade of the assembly is extended into the film web, severing the film web so that the load can be transported off the conveyor with the sealing mechanism pressing the trailing edge of the film onto the package wrap. The sealing mechanism is retracted and the cutting and sealing assembly is transported away from the film web leaving a new leading film edge held by the turntable clamps to begin the next wrap cycle.

16 Claims, 8 Drawing Figures

ECONOMY AUTOMATIC WRAPPING APPARATUS

BACKGROUND OF THE INVENTION

The present invention generally relates to packaging and more particularly to a method and apparatus for making unitary packages which hold a plurality of components, each package containing a load wrapped in a web of stretched material.

Case packing or boxing is a common way of shipping multiple unit products. The multiple unit products are generally stacked in a corrugated box or are wrapped with kraft paper with the ends of the kraft paper being glued or taped. Another way of shipping such products is by putting a sleeve or covering of heat shrinkable film around the products and shrinking it to form a unitized package. The use of heat shrinkable film is described in U.S. Pat. Nos. 3,793,798; 3,626,654; 3,590,509 and 3,514,920. A discussion of this art is set forth in U.S. Pat. No. 3,867,806.

The present invention provides a simple, reliable and inexpensive machine and method of unitizing multiple unit products into a single wrapped package with a stretched overwrap material.

When the present process and apparatus is compared with other apparatus and processes currently used to pack products in corrugated boxes and the cost of the corrugated boxes themselves, the invention shows an enormous cost savings. The invention has comparable costs with kraft wrap but it gives a much tighter and better unitized package than that possible with kraft wrap. In addition to these factors the invention is designed to use a stretch cling type film material, which provides product visibility not possible with kraft or corrugated wrapping plus a desirable feature eliminating the heat seal required in other kinds of stretch wrapping apparatus. Furthermore, the present inventive system offers packaging speed, reliability of package seal and energy savings in that less energy is required to package the products.

A basic problem with shrink and non-cling stretch film packaging is that the primary strength and reliability of the package is determined by the consistent quality of the seal. These seals depend on a careful maintenance of the sealing jaw and are never as strong as the film itself. The time that it takes to make the seals is a limiting factor on the possible speeds of most shrink systems and a consideration in stretch systems.

The present invention does not require a structural seal and therefore can use any type of stretchable material. The invention is designed to function with a stretchable plastic cling material such as P.V.C. or cling polyethylene. In the invention the apparatus utilizes a single mechanism which effectively cuts and secures the trailing edge of the film web to the underlying film wrap. Furthermore the invention can be used with a full web application or a spiral wrap application.

The use of spiral wrapping machinery is well known in the art. One such apparatus is shown by U.S. Pat. No. 3,863,425 in which film is guided from a roll and wrapped around a cylindrical load in a spiral configuration. A carriage drives the film roll adjacent the surface of the load to deposit an overlapping spiral wrap around the load and return in the opposite direction to deposit another spiral overwrap around the load. Other spiral wrapping apparatus are described by U.S. Pat. Nos. 3,857,486; 3,788,199; 3,549,017; 3,412,524, 3,191,289 and 2,716,315. The previously indicated patents rely on heat shrink material, adhesives, a heat seal or the tacky nature of the film to hold the outer layer of wrap in a fixed position.

The use of full web wrapping machinery is also known in the art. A full web stretch wrapping apparatus using a rotatable turntable is described in U.S. Pat. No. 3,867,806. Other full web wrapping apparatus are disclosed by U.S. Pat. Nos. 3,514,920; 3,793,798; 3,795,086 and 3,986,611. In this regard it should be noted U.S. Pat. No. 3,986,611 uses a tensioned cling film while U.S. Pat. No. 3,975,086 uses a tacky P.V.C. film.

The turntable clamping assembly disclosed in this specification is disclosed in U.S. Pat. No. 4,077,179.

Various patents have described the use of mehanisms for handling wrapping materials. In U.S. Pat. No. 3,003,297 a complex cutting and holding mechanism is used to place tape on a box and cut it off with the process being repeated for each box. The use of adhesive on the tape to bond it to the package is an integral part of the function of this concept. Without this adhesion it would not work either in single, multiple or spiral configurations. The unique design and function of the clamping and sealing mechanism in the present invention does not require a heat seal of the film in order for the system to operate.

U.S. Pat. No. 2,088,133 discloses a reverse wrapping wire tying machine. In the reference a gripper mechanism holds a band in position with respect to the load to be wrapped and a rotatable ring drive rotates the band around the load until the band has completed more than one wrap of the load and passes over the body of the gripper. A separator slide is used to separate the leading edge of the band from the underlying band and a second gripper mechanism attaches to the separated band. A heat sealing mechanism welds the wrapped layer band to the band underneath it and a cutting mechanism severs the leading edge of the band held by the second gripper mechanism which then becomes the trailing edge of the succeeding wrap. When the band is severed the ring drive mechanism is rotated in a reverse direction for the following load with the various gripping and cutting mechanism functioning in the same manner.

Additional references of interest which are pertinent to rotatable drives for wrapping packages are disclosed in U.S. Pat. Nos. 3,820,451, 3,331,312, 3,324,789, 3,309,839, 3,207,060, 2,743,562, 2,639,751, 2,330,629, 2,054,603 and 2,124,770.

The present invention uses stretchable plastic cling film in its preferred embodiment since the stretched cling film can be brush sealed to hold the wrap without the necessity of a heat seal. The elasticity of the cling film holds the products under more tension than either the shrink wrap or the kraft wrap particularly with products which settle or relax when packaged.

Various other apparatus and processes owned by the assignee utilize stretch material in package wrapping. Such apparatus and processes are disclosed in U.S. Pat. Nos. 3,867,806, 4,050,220, 4,077,179 and 4,079,565.

Additional benefits occur in the present invention over the prior art in that no changeover is required in handling random size units of a variety of materials as the apparatus is constructed to handle such random size units. Furthermore, the apparatus provides a substantially continuous wrapping operation so that loads can be wrapped at any desired speed and for any time period. A significant economic factor is also present in the present invention as the power requirements are significantly less than those of shrink systems since there is no heat tunnel required and greater speeds of operation are possible because of the elimination of the conventional heat seal which is used in noncling wrapping. Furthermore a wider number of products can be handled by the present invention because of the elimination of the heat seal requirement. Because of the simplicity of the construction of the invention there is a greater stability in the inventive wrapping apparatus with less maintenance being required to maintain the apparatus resulting in a corresponding reduction in breakdown time. Another desired characteristic resulting from the apparatus construction is that the invention does no take up much floor space and can be used with either full web or spiral wrapping applications.

SUMMARY OF THE INVENTION

The present invention generally comprises a novel apparatus and process for automatically making full web or spiral wrapped unitary packages having an overwrap which is not heat sealed. In the apparatus a series of loads, each containing a plurality of units are singularly fed into a turntable adjacent the wrapping apparatus.

The leading edge of the film from the film dispenser is held by a clamp mechanism of the turntable and the turntable is rotated to wrap the load with cling film which is stretched as it is wrapped around the load. After the first one and one quarter revolutions of the turntable, the turntable clamp releases the leading edge of the film web and is withdrawn below the turntable surface. The stretched overwrap film web holds the released leading edge of film against the load and continues to be wrapped around the load until the turntable reaches the home position and stops. The cutting and sealing assembly is then transported into the film path engaging the film to push it out of its original path orientation. The turntable clamp assembly is rotated upward to grab the lower portion of the stretched film web and the sealer mechanism is activated to engage the trailing edge of the film web and hold it against the film wrap. The cutter blade of the assembly is extended into the film web and severs the film web so that the load can be transported off the conveyor as the sealer mechanism presses the trailing edge of the cling film onto the package overwrap. The sealer mechanism is retracted and the cutting and sealing assembly transported away from the film web and its dispensing path leaving a new leading film edge held by the turntable clamps to begin the next wrap cycle.

The above-mentioned purpose and operations of the inventor are more readily apparent when read in conjunction with the following description of the drawings and the detailed description of the preferred embodiment of the present invention.

DETAILED DESCRIPTION OF THE DRAWINGS

Figure 8:
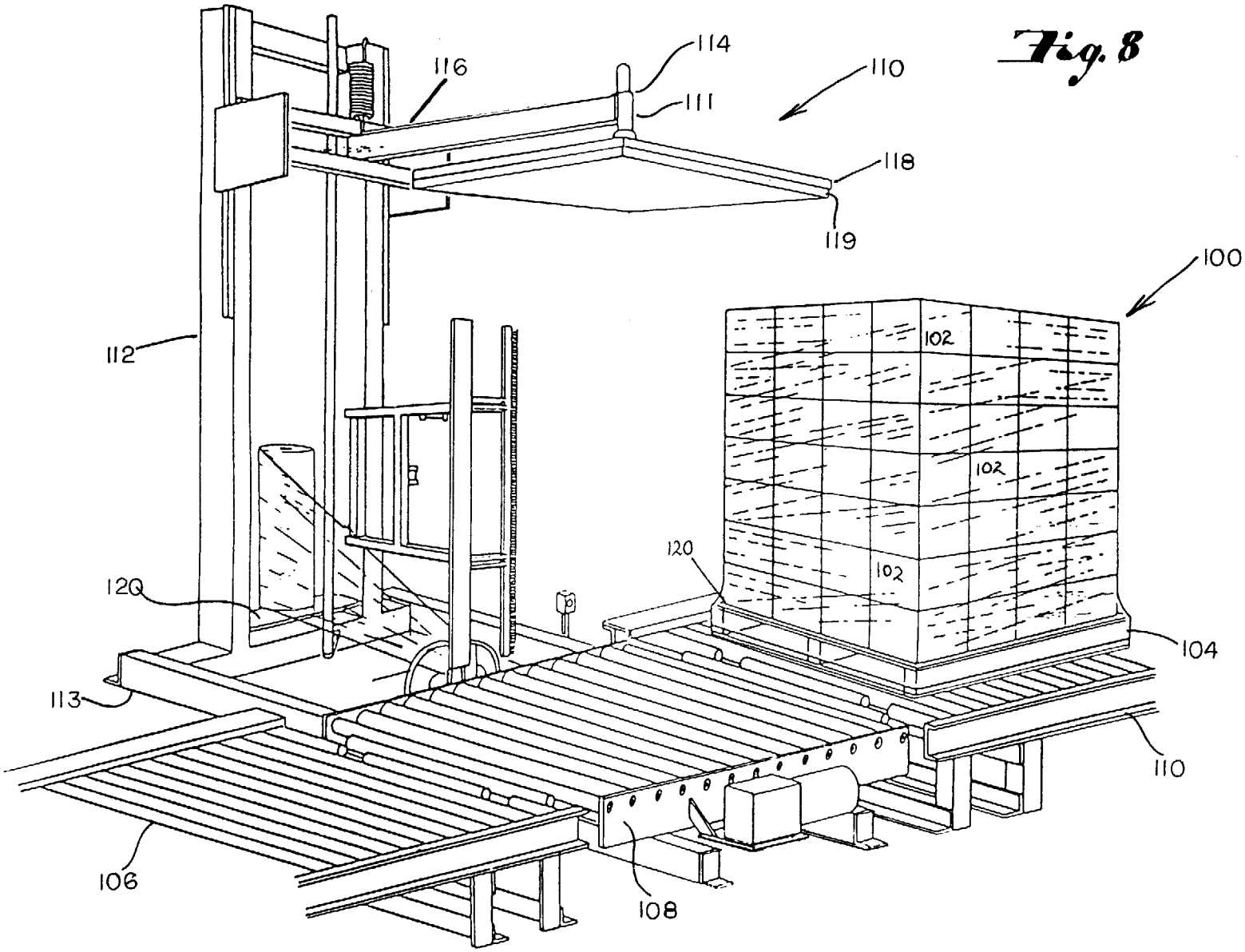
FIG. 8 is a perspective view of the alternate spiral wrap embodiment of the invention.

The present invention pertains to a simple compactly constructed economical automatic wrapping apparatus 10 which is shown by FIGS. 1–8. While the apparatus is fully shown in the full web embodiment, which is the preferred embodiment and best mode of the invention, it will also be noted that the apparatus can work with a spiral wrapping mechanism, such as that shown in copending U.S. Patent Application No. 709,957 filed July 30, 1976 and currently pending, which application is incorporated herein by reference and by the spiral embodiment which will be later described in the specification and is shown in FIG. 8.

In the preferred embodiment and best mode of the invention a film dispensing assembly comprising a film roll 24 is mounted on a film roll support 22 and stands vertically on the support which has a rotatable mandrel which allows the film to be withdrawn from the film roll. In this embodiment the film roll remains in a single rotatable position as the support does not traverse up and down the frame as would be the case in the spiral embodiment. The film roll is of a sufficient width, so that the film web when wrapped around the load is equal to at least the height of the load, and perferably engages the pallet while extending above the top of the load thus providing a wrap around the sides of the load. The film roll support 22 is seated on frame 20, which is positioned adjacent to turntable 12. A load 100 comprising a plurality of units 102 stacked on pallet 104 is carried onto turntable 12 by power feed conveyor 16, and after the load is wrapped it is carried away from the turntable 12 by a take-off conveyor 14. The film 26 as it is taken off of the film roll 24 is initially held in turntable clamps 80, which are rotated by two rotary cylinders 78 mounted to the turntable 12. The clamps 80 can be retracted below the level of the turntable 12. The turntable clamps 80 comprise two clamp members, 80' and 80'' each of which is provided with a flexible clamping strip 81 which engages and holds the film web in a fixed position between each individual clamp members.

Figure 1:
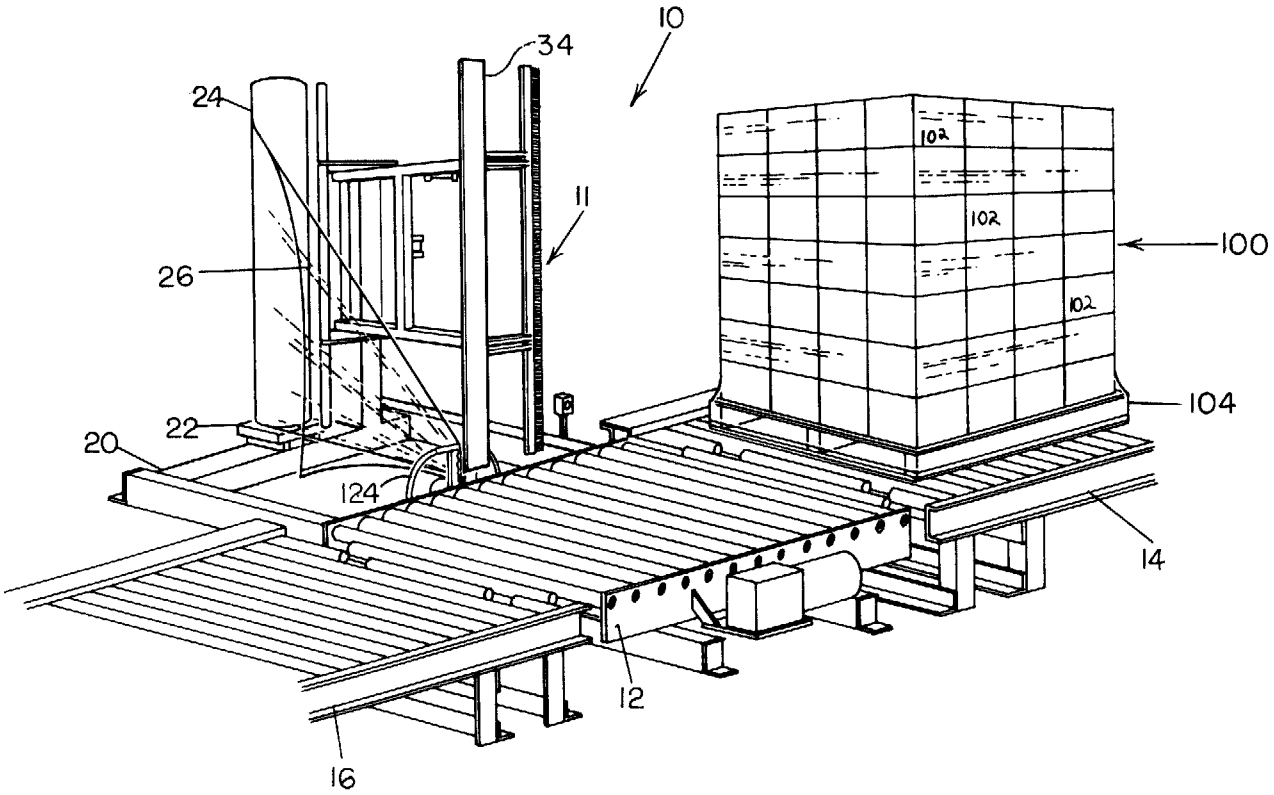
FIG. 1 is a perspective view of the novel wrapping apparatus.
Figure 2:
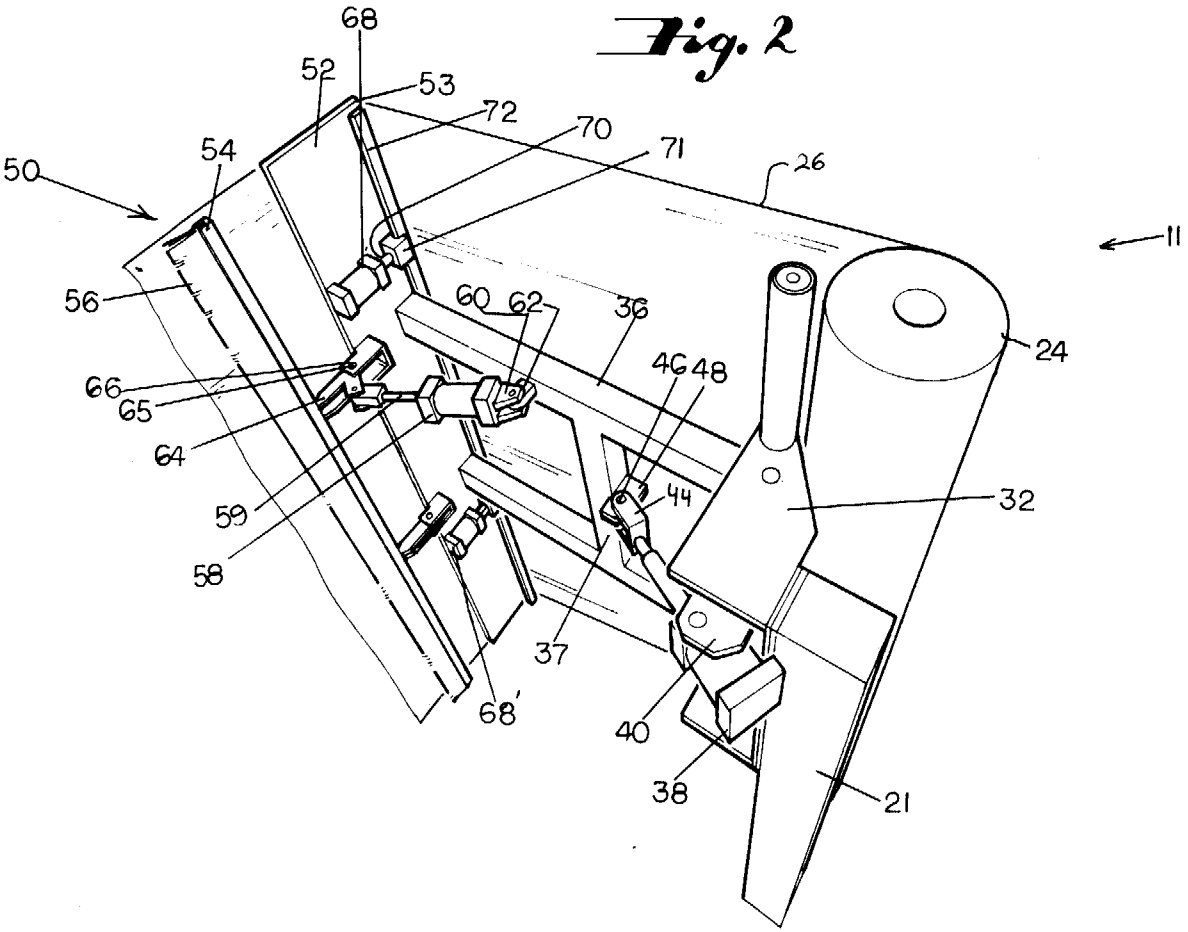
FIG. 2 is an isolated enlarged perspective view of the cutting and sealing assembly as viewed from the rear of the film roll.

The film handling assembly 11 of the invention which is best shown in FIG. 2 comprises an upright support member 21 extending from frame 20 and a bracket 32 secured to the upright support member 21. The bracket 32 has a support rod 34 vertically mounted therein. An H-shaped support member 36 is moveably mounted on a support rod 34, so that it can be rotated around the support rod by a fluid cylinder 38 which is mounted to a cylinder support plate 40, which is in turn secured to bracket 32. The cylinder 38 has a piston rod 42 with a yoke 44 on one end, the yoke being connected by a pin 46 to a connector plate 48 secured to a connecting member 37 of the H-shaped support member 36.

A film cutting and sealing assembly 50 is secured to the endsof the legs of H-shaped support member 36. The film cutting and sealing assembly comprises a vertical support plate 52 having a rounded edge 53 secured to the H-shaped support member with a retractable brush holder member 54 moveably connected thereto. The brush holder member 54 contains a brush 56 or alternately a flexible linear member which is adapted to engage and brush the outside surface of the film web so that it will cling to the underlying surface of the film wrap underneath it. The brush holder member 54 is activated by a brush cylinder 58 having a yoke 60 connected by pin means to an ear 62 projecting from the H-shaped support member 36. A piston rod 59 extends from the other end of the brush cylinder to a rotatably mounted connector member 64 which can be rotated in a bracket member 65, so that the brush can be moved sideways towards the film wrap. A pin 66 holds the rotatable connector member 64 in the bracket member 65.

A movable cutter bar 72 is held adjacent the vertical plate 52 by cutter cylinders 68 and 68'. A cutter blade 74 configured for severing the film web is secured to the cutter bar 72. The cutter blade 74 is a rip saw blade with teeth and serrations so that the teeth points penetrate the film and the rest of the blade cuts through the film. The cutter bar 72 is moved by means of cutter cylinder 68 and 68' which are secured to plate 52, each of which has a piston rod 70, 70' one end of which has a connector member 71, 71' which moves the cutter bar and its mounted cutter blade forward against the film severing it.

Figure 4:
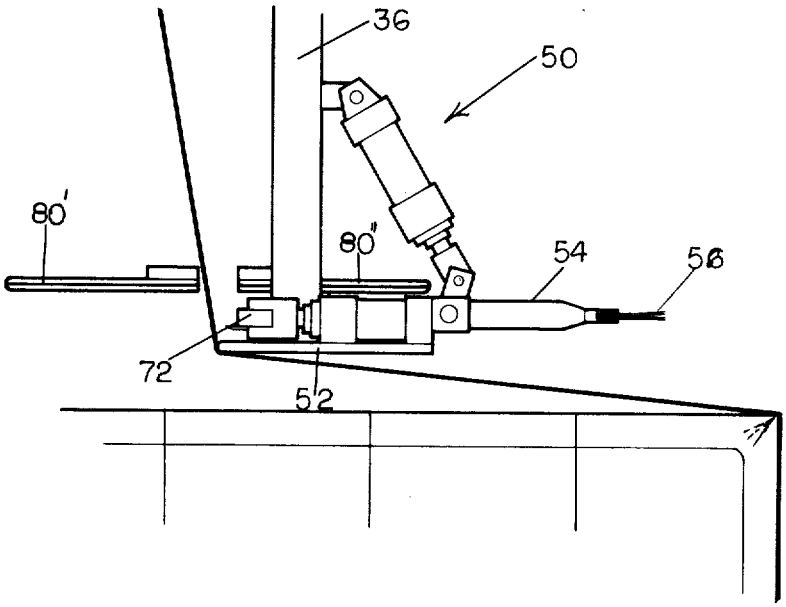
FIG. 4 is an isolated top plan view of the cutting and sealing assembly of the wrapping apparatus engaging the stretched film web at the end of the wrap cycle.
Figure 5:
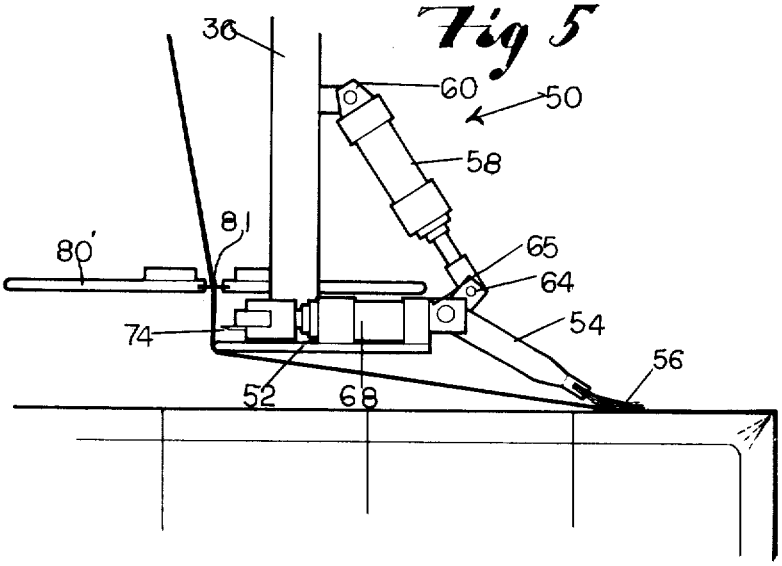
FIG. 5 is an isolated plan view of the cutting and sealing assembly of the wrapping apparatus with the turntable clamps holding the film web and the sealer engaging the film web.
Figure 6:
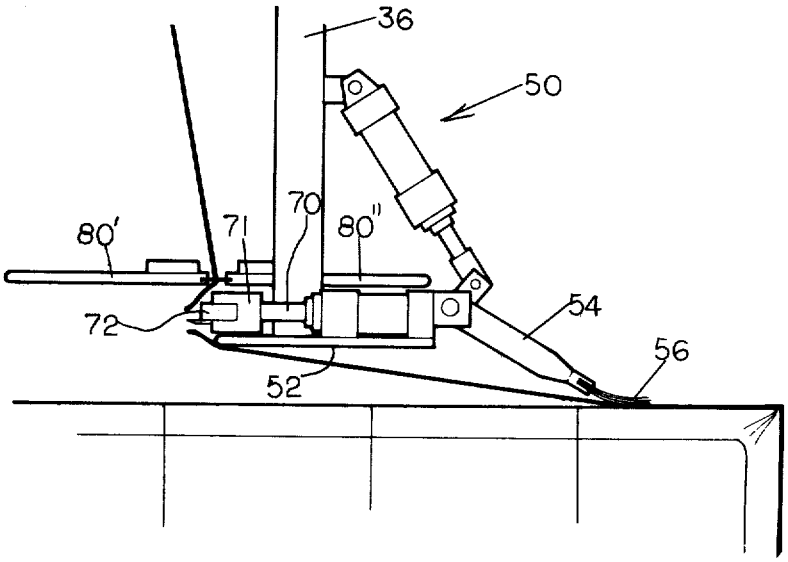
FIG. 6 is an isolated top plan view of the cutting and sealing assembly of the wrapping apparatus showing extension of the cutting blade to sever the film web.
Figure 7:
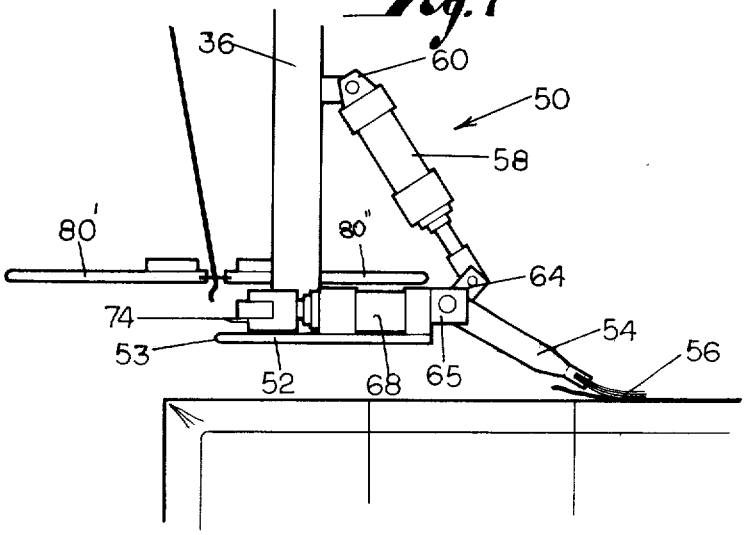
FIG. 7 is an isolated top plan view of the cutting and sealing assembly of the wrapping apparatus in which the wrapping load is carried off of the turntable and the trailing edge of the film web is brushed against the load to form a cling seal.

In the operation of the first wrapping cycle a film web 26 is pulled from the film roll and placed in the turntable clamp assembly 80 so that it is held adjacent the load. The turntable 12 is then rotated wrapping the desired number of film wraps around the load. After the first wrap of the load the turntable clamps are released and retracted below the turntable surface, so that they no longer engage the film being withdrawn by the rotating load the stretched by particle brake 28. In the home position the turntable is stopped and the cutter and brush assembly is moved into the film path by the action of cylinder 38, so that the forward edge 53 of the vertical plate 52 engages the film web as is shown in FIG. 4. The turntable clamp members 80 are then activated and rotated upward so that they engage and hold the lower portion of the film web in a fixed position, while the brush member 54 is driven toward the load by brush cylinder 58 so that the brush 56 engages the film web. At this time the cutter blade cylinders 68 and 68' are activated driving the cutter bar 72 and its associated cutter blade 74 forward to cut the film positioned between the vertical plate and turntable clamps 80 leaving a new leading edge held by the turntable clamps for the wrap cycle of the next load, while the trailing edge of the film wrap returns to its unstretched memory configuration. As the wrapped load is carried from the turntable with brush 56 engaging the trailing edge f the film, the brush forces the film against the underlying layer of film wrap where it clings or holds to the underlying layer to form a package seal. The film cutting and sealing assembly 50 is then withdrawn from the film path through the retraction of the piston rod 42 of cylinder 38 for the beginning of the next cycle wrap.

Figure 3:
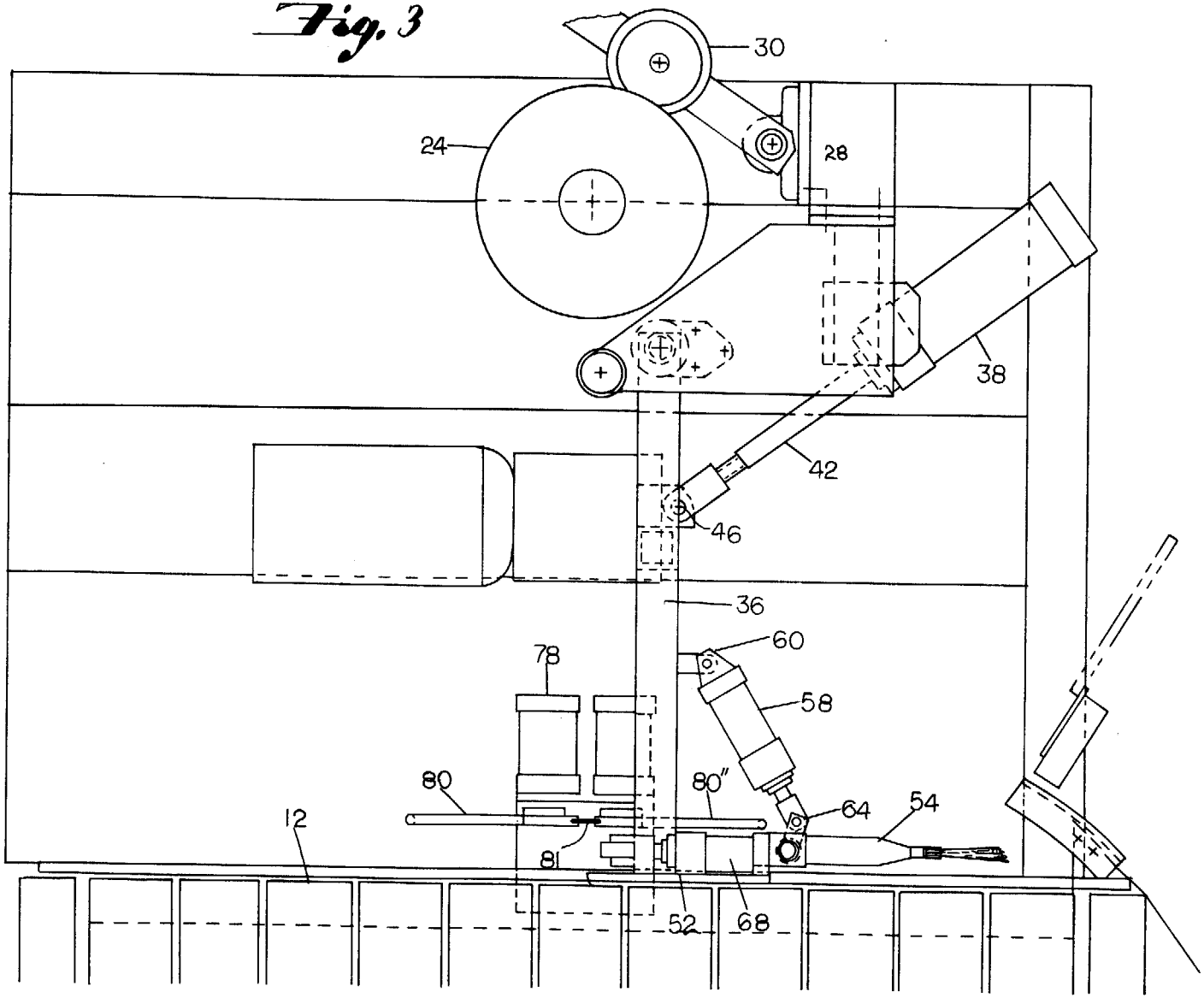
FIG. 3 is an enlarged plan view partially in section of the wrapping apparatus.

The spiral wrapping apparatus 110 comprises an upright frame 112 sitting on a base 113. A platen assembly 114 is mounted on the frame 110 for vertical movement along the frame. The platen assembly 114 comprises a support structure 116 mounted to the frame and platen 118 rotatively mounted to the support mechanism. The platen has a flexible lower surface 119 which is adapted to be placed on the top of the load 100 comprising a plurality of unitary members 102 stacked on a pallet 104. The lower surface 119 of the platen is lowered onto the top of the load 100 after the load 100 is carried by power feed conveyor 106 onto turntable 108. When turntable 108 is rotated the platen 118 rotates within journal 111 of the platen assembly holding the units in position on the load as the spiral wrap is stretch wrapped around the load. The platen provides a force on the units 102 to prevent the units from being displaced or pulled from the load as the stretched film material is wrapped around the load. A film roll support or carriage 120 is moveably mounted on the frame 112. The film roll carriage 120 includes a film roll mandrel or vertical holding member which holds the roll of film 24 of cling polyethylene or tacky PVC material. The film roll carriage 120 can be mounted in guides or tracks in the frame and is preferably driven by a rack and pinion drive, although chain, screw or other known drives well known in the art could be readily adapted to the invention. The film roll as shown in FIG. 3 is engaged or connected to a magnetic particle brake 28 which applies a restrictive force upon the film roll subjecting the film material to a braking force causing it to stretch as it is wrapped around the load. This restrictive force is preferably applied by utilizing roller 30 as shown in FIG. 3 to engage the outside of the film roll and apply constant force on the film roll, uniformly stretching the film as it leaves the roll.

In the initial operation of the spiral embodiment the cutter and sealer assembly 50 is in the retracted position and the film web 26 is placed in the turntable clamps 124 and held in a fixed position. The load 100 is moved onto the turntable 108 by power conveyor 106. The turntable is then rotated by appropriate driving mechanism (not shown) which is well known in the art and braking force is applied to the web of stretchable material causing it to be substantially stretched anywhere from 10% to 50%. After one and one half revolutions of the turntable 108 the material roll support carriage 120 is driven upward and the turntable clamps 124 open. When the stretched film material reaches the top of the load 100 the roll carriage stops its upward travel and remains in that position until a number of predetermined wraps are accumulated around the top of the load for stability or packaging reasons. Once the predetermined number of wraps have been accumulated around the top of the load, the carriage moves downward carrying its associated roll of film until it reaches its original position thereby covering the load with two spiral overwraps of stretched film.

The turntable then stops in its home position and the cutting and sealing assembly is extended into the film path by its cylinder 38 in the manner previously discussed in the full web embodiment, with the cutting and sealing assembly working in the identical manner described in the full web embodiment.

In the foregoing description the invention has been described with reference to a particular embodiment although it is to be understood that the specific details shown are merely illustrative and that the invention may be carried out in other ways without departing from the true spirit and scope of the following claims.

What is claimed is:

1. The process of making a unitary package from a load comprising a plurality of units comprising:

(a) placing a leading edge of a roll of stretchable film from a dispensing means adjacent a load in a clamp to hold it in a fixed position;

(b) applying tension to the roll of stretchable film so that the film web is stretched at least 20% as it is removed from the roll;

(c) wrapping the load with a plurality of layers of stretched film web by rotating the load while removing the clamp so that the leading edge of the roll of stretched film is released and held against said load by an overwrap of said stretched film;

(d) stopping the wrapping of said load;

(e) moving a web extending means into the path of said stretched film web to engage the stretched film web and distort the film web out of the flow path it initially occupied when the wrap was stopped;

(f) clamping at least a portion of the distorted stretched film web in said clamp between the extruding means and the dispensing means;

(g) extending a cutting means mounted to the web extending means into the film web from the same side of the film web that the web extending means engages the film web thereby severing the web without any opposing force on the other side of the film web after the film has been distorted from its initial flow path; and (h) pressing the trailing edge of the film web against an underlying film wrap layer.

2. The process according to claim 1 wherein said roll of stretchable material is a cling-type film.

3. A process according to claim 1 wherein said web of stretchable material has a width substantially equal to the height of the load.

4. The process of claim 1 including the step of fastening the severed trailing end of the stretched material to the material overwrap.

5. The process of claim 1 including the step of moving the dispensing means in one direction along the surface of the rotating load to form a plurality of overlapping wraps on the surface of the load and then moving the dispensing means in an opposite direction back along the path which is originally travelled to form a plurality of overlapping wraps over the wrapped surface of the load after step c.

6. A process of making a spirally wrapped unitary package from a load comprising a plurality of units comprising:

(a) placing the leading edge of a roll of stretchable material having a web width less than the height of the load from a dispensing means adjacent a load;

(b) holding said leading edge of said roll of stretchable material in a fixed position adjacent said load;

(c) applying tension to the roll of stretchable material so that the material is stretched as it is removed from the roll by rotating the load;

(d) moving the dispensing means in a direction parallel to the center axis of the rotating load away from one end of the load to form a plurality of spiral overlapping wraps on the surface of the load;

(e) stopping the wrapping of the load when the load has been wrapped;

(f) moving a web extending means into the path of said stretched material to engage the stretched film material and exert a force against the film web to extend the film web out of the flow path it initially occupied when the wrap was stopped, and maintaining said web extending means in a fixed position against said film web;

(g) clamping the extended stretched film material between the web extending means and the dispensing means;

(h) extending a cutting means moveably mounted on the web extending means into the film web, in the same direction in which the film web had been extended by the web extending means after the film web has been extended from its intial flow path, severing the film web, said film web being unrestricted from the opposite direction; and (i) removing the web extending means away from the film path to a home station to begin a new wrap cycle.

7. An apparatus for making a unitary package comprising a frame, a film dispensing means mounted on said frame, a turntable positioned adjacent said film dispensing means and adapted to support a load, drive means connected to said turntable adapted to rotate said turntable and an associated load mounted on said turntable to cause a web of film to be pulled from said dispenser means to overwrap said load, brake means connected to said film dispensing means, said brake means being adapted to restrict movement of the film web from said film dispensing means so that the film web is stretched as it leaves the film dispensing means, film handling means positioned adjacent said film dispensing means, said film handling means comprising a frame, a unitary support member moveably mounted on said frame, a support plate mounted to one end of said unitary support member adapted to engage said film web on one side of the film web and move said film web from its initial path of travel to a position beside the load which is substantially unopposed between the load and the dispensing means on one side of the film web, fluid cylinder means mounted to said support plate, said fluid cylinder means being connected to a moveable cutter blade assembly, said cutter blade assembly comprising a blade holder and a blade mounted to said blade holder, said blade having a length greater than the width of said film web and being adapted to be driven from the same side of the film web that the support plate engages into the same side of the film web that the support plate engages, the film being mechanically unopposed on the opposite side from the side of engagement, and means connected to said unitary support member to selectively transport said support plate into said film web path for engagement with said film web and out of said film web path for initiation of a new wrap cycle and clamp means positioned adjacent said film handling means at said position for holding said web of material in a fixed position.

8. A vertically oriented apparatus for making a unitary package comprising a frame, a film dispensing means mounted on said frame, a turntable positioned adjacent said film dispensing means and adapted to support a load, a clamp assembly mounted to said turntable adapted to hold film dispensed from said film dispensing means, drive means connected to said turntable adapted to rotate said turntable and an associated load mounted on said turntable to cause a film web to be pulled from said film dispensing means to overwrap said load, brake means connected to said film dispensing means, said brake means being adapted to restrict movement of film from said film dispensing means so that the web of the film is stretched as it leaves the film dispensing means, and film handling means positioned adjacent said film dispensing means, said film handling means comprising a frame, a support member moveably mounted on said frame, a plate member mounted to said support member, means to transport said support member and plate member, said transport means being connected to said support member to transport said plate member into and out of the film web path defined by the film flow from the film dispenser onto the load, said plate member engaging said film web on one side of the film web when transported into the film web flow path and carrying the film web to a new position adjacent said clamp assembly in which the film web is subject to force applied by the plate member which is substantially unopposed between the load and the film dispensing means, fluid cylinder means mounted to said plate member, said fluid cylinder means being connected to a cutter blade and adapted to move said cutter blade into the side of the film web engaged by the plate member to sever the film web, said film web being unrestricted on its opposite side from that side engaged by the plate member between said load and said clamp assembly and film wrap sealer means moveably connected to said plate member, said film wrap sealer means being adapted to engage the film web dispensed from said dispensing means and press said film web against said load overwrap.

9. Apparatus as claimed in claim 8 wherein said support member is H-shaped and is rotatably mounted on a support rod mounted to said frame.

10. An apparatus as claimed in claim 8 wherein said sealer means comprises a wiper holder moveably mounted to said base plate member, fluid cylinder means mounted to said support member and connected to said wiper holder and a wiper member mounted in said wiper holder.

11. Apparatus as claimed in claim 10 wherein said wiper member is a brush.

12. Apparatus as claimed in claim 10 wherein said wiper member is linear member flexible linear member.

13. Apparatus as claimed in claim 8 wherein said brake means comprises a particle brake and a roller adapted to engage said film roll.

14. Apparatus as claimed in claim 8 wherein said cutter blade is mounted in a cutter holder, said cutter holder being mounted to fluid cylinder means mounted on said base plate member, and adapted to reciprocate along the surface of said base plate member upon activation of said cylinder means.

15. Apparatus as claimed in claim 14 wherein said film is a cling-type film.

16. A vertically oriented apparatus for making a unitary package comprising a frame, a film dispensing means mounted on said frame, a turntable positioned adjacent to said film dispensing means and adapted to support a load, film clamp means rotatably mounted on said turntable, drive means connected to said turntable adapted to rotate said turntable and an associated load mounted on said turntable to cause a web of material to be pulled from said dispensing means to overwrap said load, brake means connected to said film dispensing means, said brake means comprising a particle brake and roller assembly adapted to restrict the movement of the material from said film dispensing means so that the web of material is stretched as it leaves the film dispensing means, a film handling means positioned adjacent said turntable, said film handling means comprising an upright frame and a single H-shaped support member moveably mounted on a rod connected to said frame, fluid cylinder means mounted on said frame including a piston rod, said piston rod being moveably mounted to said single H-shaped support member for moving said H-shaped support member around said support rod to move one end of said H-shaped support member towards the path of the film being dispensed from said film dispensing means, a plate mounted to the ends of said H-shaped support member in a vertical position, said plate engaging one side of the film web when moved into the path of the film and carrying the film web out of its initial path of travel into a position adjacent said clamp means in which at least a portion of the film web is positioned proximate a sidee of the load, said plate member when carrying the film web into the angular position placing a substantially unopposed force on the film web between the load and the dispensing means, a cutter assembly slidably mounted on said vertical plate, said cutting assembly comprising a blade holder and a blade mounted in said blade holder, fluid cylinder means mounted on said vertical plate, said fluid cylinder means comprising a piston and a piston rod, said piston rod being secured to said blade holder to drive said blade holder and blade into the side of the film web engaged by the support member plate to sever the film web, and overwrap sealer means moveably connected to the said vertical plate, said overwrap sealer means comprising a sealer holder moveably connected to said vertical plate by moveable connector means, a fluid cylinder including a piston rod having one end connected to said H-shaped support member with the piston rod connected to said moveable connector means, said moveable connector means allowing said sealer holder to move a predetermined distance from said vertical plate so that it may be driven sideways by the action of said fluid cylinder, a sealer means mounted in said sealer holder, said sealer means being adapted to engage said film web and press said film web against said load overwrap, so that said film web is sealed against said film overwrap.

* * * * *